US011365873B2

(12) United States Patent
Tuulos

(10) Patent No.: US 11,365,873 B2
(45) Date of Patent: Jun. 21, 2022

(54) SUSPENDED LUMINAIRE LEVELLING SYSTEMS

(71) Applicant: LMPG Inc., Surrey (CA)

(72) Inventor: Brian Tuulos, Anmore (CA)

(73) Assignee: LMPG Inc., Surrey (CA)

( * ) Notice: Subject to any disclaimer, the term of this patent is extended or adjusted under 35 U.S.C. 154(b) by 0 days.

(21) Appl. No.: 16/971,469

(22) PCT Filed: Feb. 22, 2019

(86) PCT No.: PCT/CA2019/050221
§ 371 (c)(1),
(2) Date: Aug. 20, 2020

(87) PCT Pub. No.: WO2019/161506
PCT Pub. Date: Aug. 29, 2019

(65) Prior Publication Data

US 2020/0378587 A1 Dec. 3, 2020

Related U.S. Application Data

(60) Provisional application No. 62/634,422, filed on Feb. 23, 2018.

(51) Int. Cl.
*F21V 21/16* (2006.01)
*F21S 8/06* (2006.01)
*F21V 21/008* (2006.01)

(52) U.S. Cl.
CPC ..... *F21V 21/16* (2013.01); *F21S 8/061* (2013.01); *F21V 21/008* (2013.01)

(58) Field of Classification Search
CPC ..... F21V 21/16; F21V 21/18; F21V 21/20; F21V 21/008; F21V 21/112; F21S 8/06; F21S 8/061; F21S 8/068; F21S 8/026; G09F 2007/186; F16M 11/045; F16M 11/125; F16M 11/10; F16M 2200/041
USPC ..... 248/328; 362/391, 289, 273
See application file for complete search history.

(56) References Cited

U.S. PATENT DOCUMENTS 320,172 A * 6/1885 Robinson ..... B25B 13/16 81/171
626,285 A * 6/1899 Metzger ..... B25B 7/00 81/390
3,512,743 A 5/1970 Lipscomb
3,919,459 A * 11/1975 Van Steenhoven ..... F21V 23/02 174/63

(Continued)

FOREIGN PATENT DOCUMENTS

KR 101399291 B1 6/2014
KR 101429859 B1 8/2014
WO WO-2008095491 A1 * 8/2008 ..... F21V 21/14

*Primary Examiner* — Jong-Suk (James) Lee
*Assistant Examiner* — James M Endo
(74) *Attorney, Agent, or Firm* — Oyen Wiggs Green & Mutala LLP

(57) ABSTRACT

A system and method are provided for levelling suspended luminaires. The system includes a shuttle and a thumb wheel disposed in a housing. The shuttle includes a gripper for securing the cable wires that attach to the luminaire. A rotational movement of the thumb wheel is translated to linear movement of the shuttle within a slot of the housing to allow adjustment of an attachment point of the cable wire relative to the rest of the luminaire to enable tool-free levelling of the luminaire.

6 Claims, 4 Drawing Sheets

(56) References Cited

U.S. PATENT DOCUMENTS 4,044,710 A * 8/1977 Hansen ..... G09F 11/23 116/312
4,446,626 A * 5/1984 Grender ..... G01C 15/02 248/328
6,517,222 B1 * 2/2003 Orlov ..... F21S 8/06 248/325
6,520,484 B1 * 2/2003 Shimizu ..... B66D 1/50 254/276
7,142,358 B2 * 11/2006 Pomerantz ..... G01N 21/87 359/368
7,284,465 B1 * 10/2007 Chen ..... B25B 13/14 81/165
8,573,551 B2 * 11/2013 Hung ..... F16M 11/12 248/286.1
8,576,571 B2 * 11/2013 Chen ..... G03B 21/54 361/747
8,596,892 B2 * 12/2013 Murrow ..... F16M 11/16 396/428
2001/0036077 A1 11/2001 Buss et al.
2004/0057239 A1 * 3/2004 Lupicki ..... F21V 23/02 362/401
2004/0218393 A1 * 11/2004 Brondt ..... F21S 8/06 362/391
2006/0196317 A1 * 9/2006 Kinskey ..... B25B 13/463 81/63.1
2007/0246631 A1 * 10/2007 Brown ..... F21V 21/112 248/343
2009/0294619 A1 * 12/2009 David ..... F16M 11/2035 248/324
2011/0023401 A1 * 2/2011 Warton ..... F21S 8/06 52/506.08
2013/0094230 A1 4/2013 Verfuerth et al.
2016/0290613 A1 * 10/2016 Harvey ..... F21S 9/02
2017/0102113 A1 * 4/2017 Wu ..... F21V 21/112
2018/0347792 A1 * 12/2018 Chen ..... F21S 2/00

* cited by examiner

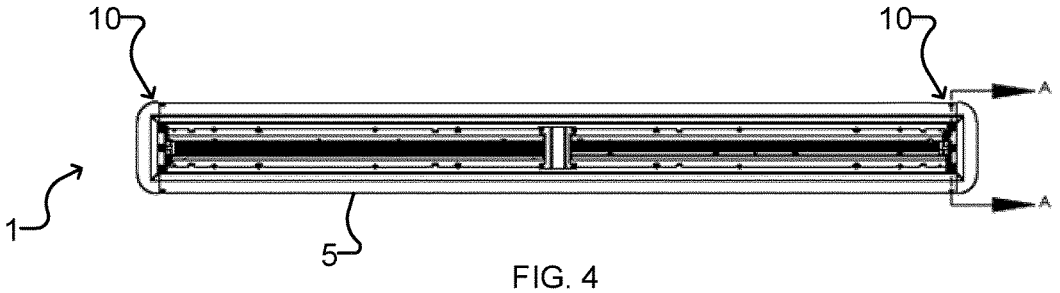
FIG. 4
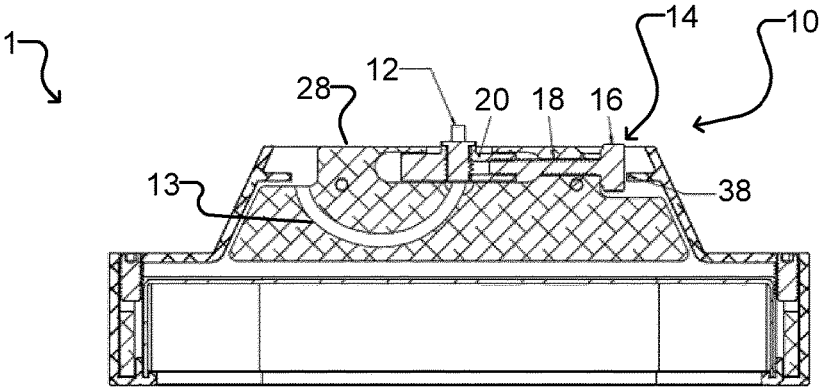
FIG. 5A
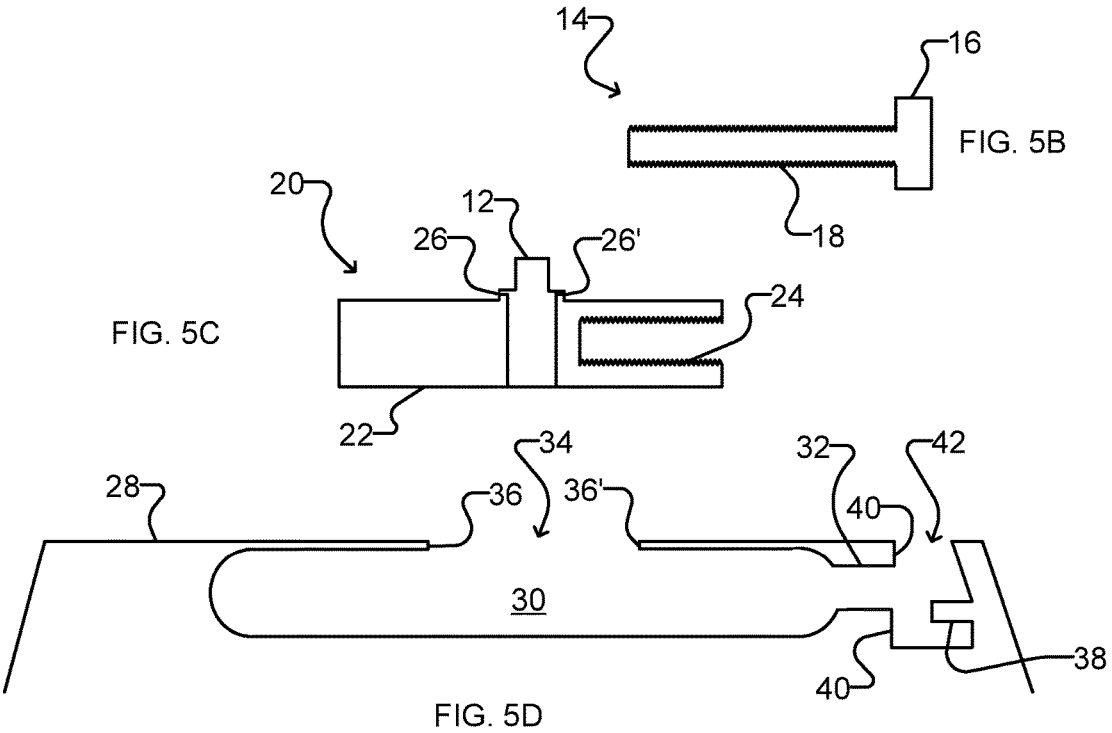
FIG. 5B
FIG. 5C
FIG. 5D

SUSPENDED LUMINAIRE LEVELLING SYSTEMS

REFERENCE TO RELATED APPLICATIONS

This application claims priority to and the benefit of U.S. provisional patent application No. 62/634,422 filed 23 Feb. 2018 which is hereby incorporated by reference in its entirety.

TECHNICAL FIELD

This invention relates to systems for levelling suspended luminaires.

BACKGROUND

Luminaires designed to be suspended are manufactured to ideally be balanced, i.e., with their mass distributed equally about the points from which they are suspended, so that they hang level in the air. Issues during manufacturing, such as twisting during extrusion of the luminaire body, may result in unequal mass distribution and thus an unbalanced luminaire. Even if the luminaire itself is balanced, shipping issues, onsite conditions and/or other circumstances may cause a luminaire not to be level when suspended. Set screws are known to be used to level suspended luminaires but set screws can be fussy and require tools. A tool-free system for easily levelling suspended luminaires is desirable.

SUMMARY OF THE INVENTION

Aspects of the invention relate to a system for levelling suspended luminaires. The system includes a housing, a shuttle and a thumb wheel. The housing has a first opening and a second opening. The first opening connects to a slot. The shuttle may be disposed in the slot. The shuttle has a gripper and a threaded bore. The thumb wheel is disposed in the housing. The thumb wheel has a head at least partially exposed to the second opening and a drive shaft including a threaded portion for mating engagement with the threaded bore of the shuttle. Linear displacement of the thumb wheel may be constrained by the housing. Rotation of the thumb wheel may drive linear displacement of the shuttle.

In some embodiments, the first opening includes a first edge and a second edge and the shuttle includes a first shoulder and a second shoulder. A first position of the shuttle of the first shoulder may abut the first edge and a second position of the shuttle of the second shoulder may abut the second edge. The linear displacement of the shuttle may be constrained between the first position and the second position.

In some embodiments, the housing includes an unthreaded bore for holding a proximal portion of the drive shaft. The unthreaded bore may be connected to the slot.

In some embodiments, the housing includes a collar and a projection. The collar defines an end of the unthreaded bore opposite the slot. The collar and the projection may cooperate to constrain linear displacement of the head of the thumb wheel.

In some embodiments, the gripper includes an axial bore for gripping a cable wire.

In some embodiments, the housing includes a channel. The channel may be in communication with the axial bore of the tripper. The channel may be dimensioned to house any length of the cable wire from the axial bore of the gripper.

In such embodiments, any excess length of the cable which extends beyond the channel may be clipped by a user.

An aspect of the invention relates to a luminaire. The luminaire includes a body and one or more systems for levelling suspended luminaires. The one or more systems each are at least at one point of attachment of the body with cable wire for suspending the luminaire.

An aspect of the invention relates to a method of levelling a suspended luminaire. The method includes providing the luminaire; suspending the luminaire from a ceiling with cable wires; and rotating the thumb wheel of at least one of the one or more systems for levelling to linearly displace at least one of the cable wires to level the suspended luminaire if the suspended luminaire is not level. In some embodiments, the last step is repeated for a plurality of the one or more systems.

BRIEF DESCRIPTION OF DRAWINGS

The accompanying drawings illustrate non-limiting example embodiments of the invention.

FIG. 4 is a top view of a suspended luminaire with a levelling system according to the embodiment shown in FIG. 1.

FIGS. 5A is a cross sectional view of a levelling system according to the embodiment shown in FIG. 1 taken along the plane A-A of FIG. 4, with a shuttle in a center position.

FIG. 5B is a cross-sectional view of a thumbwheel of a levelling system according to the embodiment shown in FIG. 1.

FIG. 5C is a cross-sectional view of a shuttle of a levelling system according to the embodiment shown in FIG. 1.

FIG. 5D is a cross-sectional view of a housing of a levelling system according to the embodiment shown in FIG. 1.

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

This invention relates to luminaires, and in particular to systems for levelling suspended luminaires. Aspects of the invention relate to a system for levelling a luminaire suspended by cable wires. The system is provided at the point where the cables wires attach to the luminaire. The system includes a shuttle includes a gripper for securing the cable wires. Rotational movement of a thumb wheel is translated to linear movement of the shuttle within a slot to allow adjustment of the attachment point of the cable wire relative to the rest of the luminaire to enable tool-free levelling of the luminaire.

Figure 1:
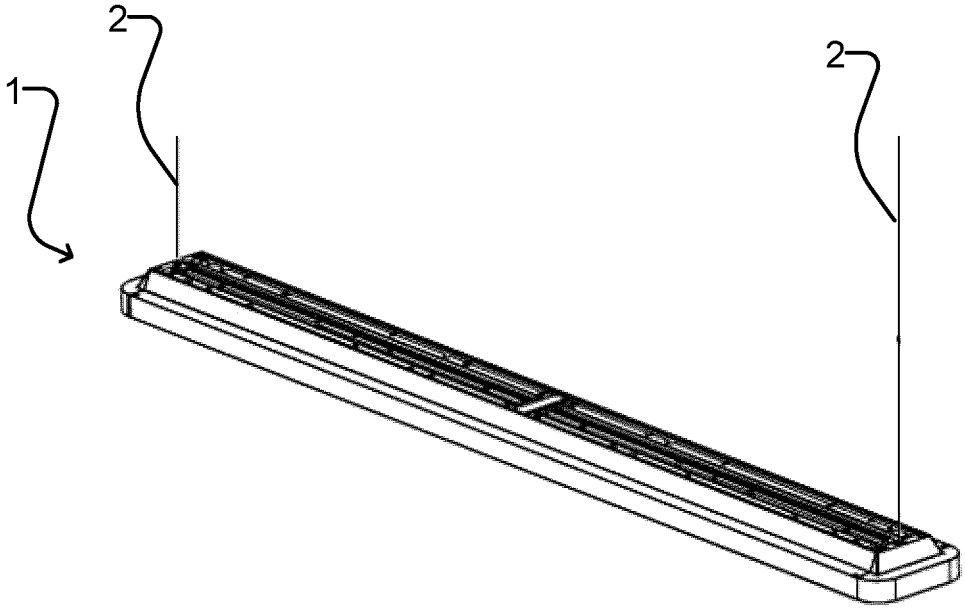
FIG. 1 is an isometric view of a suspended luminaire with a levelling system according to an embodiment of the invention.
Figure 2A:
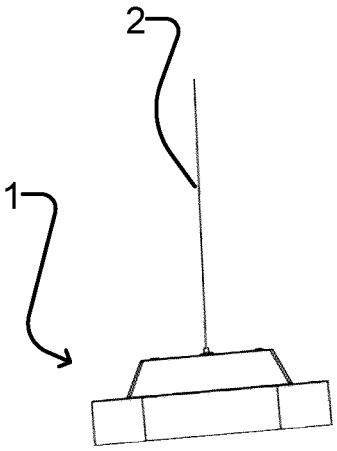
FIG. 2A is an end view of a suspended luminaire with a levelling system according to the embodiment shown in FIG. 1, wherein the luminaire is not level.
Figure 2B:
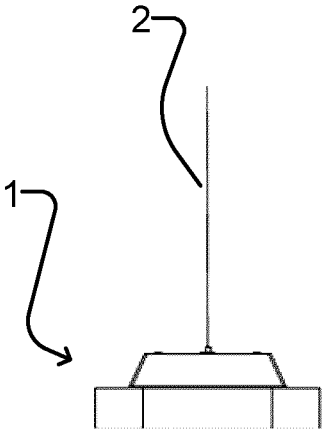
FIG. 2B is an end view of a suspended luminaire with a levelling system according to the embodiment shown in FIG. 1, wherein the luminaire is level.
Figure 3:
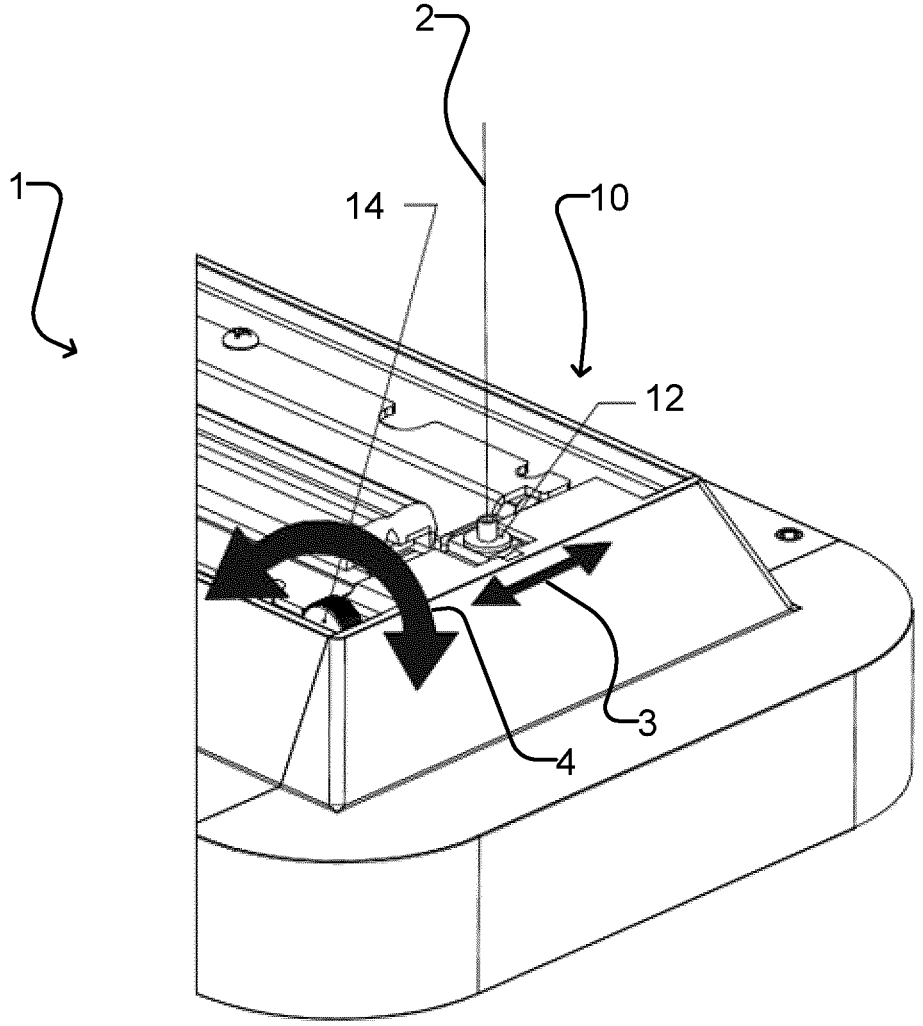
FIGS. 3 is a partial isometric view of a suspended luminaire with a levelling system according to the embodiment shown in FIG. 1.

FIG. 1 shows a luminaire 1 suspended at each end from a ceiling (not shown) by cable wires 2. FIG. 2A shows luminaire 1 not level from an end view and FIG. 2B shows luminaire 1 level from an end view.

FIGS. 3, 4, 5A-5D to 6A and 6B show a levelling system 10 provided at each end of a body 5 of luminaire 1 according to an embodiment of the invention. Levelling system 10 includes a gripper 12 that securely grips cable wire 2. Gripper 12 may have an axial bore (not shown) through which cable wire 2 extends. Spare length of cable wire 2 may be extended through channel 13, with any excess cable wire 2 extending beyond channel 13 being clipped. Gripper 12 may include a mechanism that allows it to releasably grip cable wire 2 as known in the art. Gripper 12 may be connected to (e.g. screwed into) or integral with a shuttle 20.

Figure 6A:
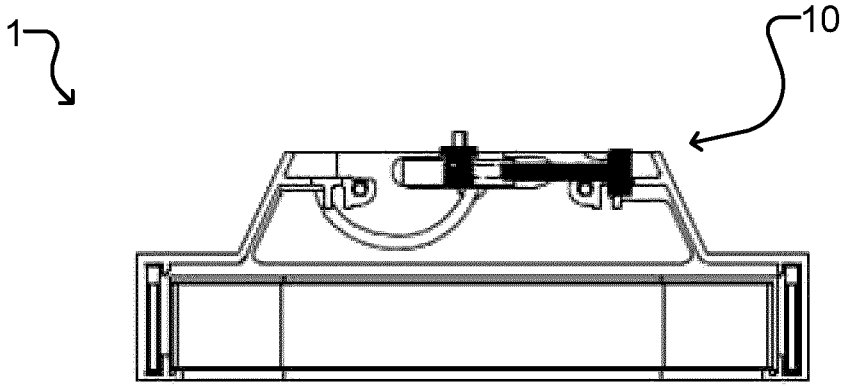
FIG. 6A is a cross sectional view of a suspended luminaire with a levelling system according to the embodiment shown in FIG. 1 taken along the plane A-A of FIG. 4, with a shuttle in a leftmost position.
Figure 6B:
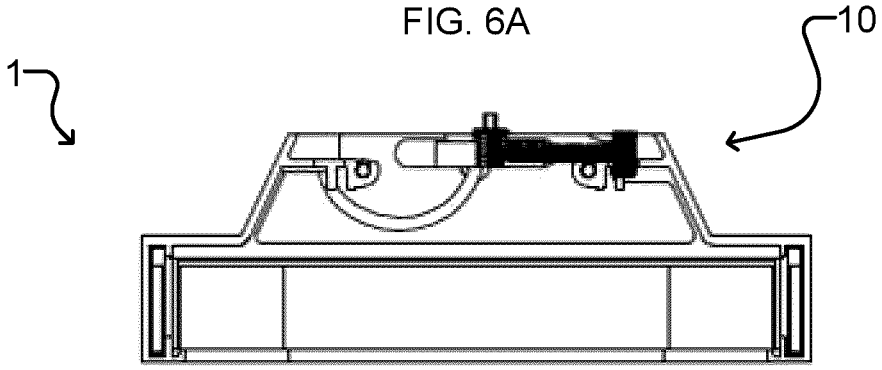
FIG. 6B is a cross sectional view of a suspended luminaire with a levelling system according to the embodiment shown in FIG. 1 taken along the plane A-A of FIG. 4, with a shuttle in a rightmost position.

Shuttle 20 is dimensioned to slidably fit within slot 30 of housing 28. The length of shuttle 20 and the length of slot 30 are dimensioned so that when shuttle 20 is positioned in a leftmost position (as shown in FIG. 6A), shoulder 26 of shuttle 20 abuts edge 36 of opening 34 of housing 28, and when shuttle 20 is positioned in a rightmost position (as shown in FIG. 6B), shoulder 26' of shuttle 20 abuts edge 36' of opening 34 of housing 28.

The positioning of shuttle 20, and consequently the positioning of gripper 12 and cable wire 2, is adjusted by rotation of a thumb wheel 14.

Thumb wheel 14 includes a head 16 and a drive shaft 18. Drive shaft 18 is threaded at least at its distal end. In the embodiment illustrated, drive shaft 18 is fully threaded. As shown in FIG. 5A, thumb wheel 14 is disposed in housing 28, with a proximal portion of drive shaft 18 within a correspondingly dimensioned bore 32 of housing 28, and a distal portion of drive shaft 18 at least partially and matingly engaged with a threaded bore 24 of shuttle 20. Axial displacement of thumb wheel 14 is constrained at head 16 by projection 38 and collar 40 of housing 28. Bore 32 is not threaded. Housing 28 has another opening 42 through which a portion of head 16 of thumb wheel 14 is exposed to allow access by a user. The circumferential surface of head 16 (exposed through opening 42 as it rotates) may be provided with a high friction surface (e.g. ribbing, or rubber material) for a user to more easily grip and therefore rotate head 16.

In operation, a user desiring to adjust the positioning of cable wire 2 rotates thumb wheel 14 at head 16 through opening 42. Thumb wheel 14 may be rotated in either of directions 4. Axial rotation of drive shaft 18 of thumb wheel 14 is translated to linear motion of shuttle 20, due to engagement of drive shaft 18 with threaded bore 24. Shuttle 20 is linearly displaced within slot 30 in directions 3 since linear displacement of thumb wheel 14 is constrained at collar 32 and projection 38 of housing 28.

In some embodiments, as illustrated, system 10 is integral with luminaire 1. In other embodiments, system 10 may be provided as a separate component from the luminaire 1, and attached to luminaire 1 before installation.

In some embodiments, as illustrated, luminaire 1 has a single point attachment with cable wires 2. In other embodiments, luminaire 1 may have multi point attachments, such as a yoke-type two point attachment, with cable wires 2; in such embodiments, both attachment points for the same cable wire 2 may attach to a single shuttle 20 of a single system 10, or each attachment point of the same cable wire 2 may attach to respective shuttles 20 of respective systems 10.

In some embodiments, as illustrated, luminaire 1 may be a generally elongated rectangular shape with a cable wire 2 at each end. In other embodiments, luminaire 1 may be other shapes, including but not limited to other types of polygons, circles, ovals and the like. The shapes may be symmetrical or non-symmetrical. Each shape may have two or more cable wire attachment points that are each provided with a system 10 as described herein to assist in levelling the luminaire during installation.

Where a component (e.g. cable wire, projection, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

As will be apparent to those skilled in the art in the light of the foregoing disclosure, many alterations and modifications are possible in the practice of this invention without departing from the spirit or scope thereof.

What is claimed is:

1. A system for levelling suspended luminaires, the system comprising:

a housing comprising a first opening and a second opening, the first opening connecting to a slot, the second opening on a top surface of the housing, and an unthreaded bore connecting the slot and the second opening;

a shuttle disposed in the slot of the housing, the shuttle comprising a gripper disposed at about a laterally midway point thereof, and a threaded bore;

a thumb wheel disposed in the housing, the thumb wheel comprising a head substantially disposed within the housing and partially exposed to the second opening and a drive shaft comprising a threaded portion for mating engagement with the threaded bore of the shuttle through the unthreaded bore of the housing;

wherein linear displacement of the thumb wheel is constrained by the housing;

whereby rotation of the thumb wheel drives linear displacement of the shuttle;

wherein the gripper comprises an axial bore for gripping a cable wire and configured for the cable wire to extend through the axial bore;

wherein the housing comprises a channel in axial alignment with the axial bore of the gripper, the channel configured for the cable wire to extend through an entire length of the channel:

wherein the threaded bore terminates before and laterally adjacent to the gripper;

and wherein the luminaires are suspended from a ceiling with the cable wire.

2. The system according to claim 1 wherein the first opening comprises a first edge and a second edge, wherein the shuttle comprises a first shoulder and a second shoulder, wherein in a first position of the shuttle the first shoulder abuts the first edge, and wherein in a second position of the shuttle the second shoulder abuts the second edge, whereby linear displacement of the shuttle is constrained between the first position and the second position.

3. The system according to claim 1 wherein the housing comprises a collar defining an end of the unthreaded bore opposite the slot, and a projection, the collar and the projection cooperating to constrain linear displacement of the head of the thumb wheel.

4. A luminaire comprising:

a body; and one or more systems according to claim 1, each one of the one or more systems providing at least at one point of attachment of the body with a cable wire for suspending the luminaire.

5. A method of levelling a suspended luminaire, the method comprising:

a. providing a luminaire according to claim 4;

b. suspending the luminaire from a ceiling with cable wires;

c. if the suspended luminaire is not level, rotating the thumb wheel of at least one of the one or more systems to linearly displace at least one of the cable wires to level the suspended luminaire.

6. The method according to claim 5 wherein step c is repeated for a plurality of the one or more systems.

* * * * *